US006749526B2

(12) United States Patent
Hughes

(10) Patent No.: US 6,749,526 B2
(45) Date of Patent: Jun. 15, 2004

(54) GOLF GREENS SPEED AND CONTOUR TEACHING DEVICE

(76) Inventor: Joe Leonard Hughes, 4981 Lake Fjord Pass, Marietta, GA (US) 30068

( * ) Notice: Subject to any disclaimer, the term of this patent is extended or adjusted under 35 U.S.C. 154(b) by 0 days.

(21) Appl. No.: 10/245,916

(22) Filed: Sep. 19, 2002

(65) Prior Publication Data

US 2004/0058754 A1 Mar. 25, 2004

(51) Int. Cl.[7] ..... A63B 57/00
(52) U.S. Cl. ..... 473/404
(58) Field of Search ..... 473/220, 404; 73/12.02; 124/16

(56) References Cited

U.S. PATENT DOCUMENTS 1,636,234 A * 7/1927 Klopsteg ..... 73/12.02
2,517,545 A * 8/1950 Cushman et al. ..... 73/12.02
3,299,692 A * 1/1967 Mizejewski ..... 73/12.02
5,818,036 A * 10/1998 Daly ..... 473/220

* cited by examiner

*Primary Examiner*—Steven Wong

(57) ABSTRACT

The golf green speed and contour teaching device is used to help the golfer learn and understand the green he is about to putt on. Golfers usually take years of practice to become proficient at learning the speed and route the ball will take when struck. He must putt over and over, and over again to familiarize himself with the terrain and the grass to be able to make the correct putt on the ball. The grass heighth, dampness and other factors are not easily understood by the novice, and can make him putt a poor shot. Also, ridges or valleys in the green make contour reading difficult. Many professionals have difficulty even after years of practice. This instrument will speed up the golfer's learning process and even the amateur can become proficient at putting. This instrument will give him wisdom.

2 Claims, 8 Drawing Sheets

22
26
27
2
10
1
42
11

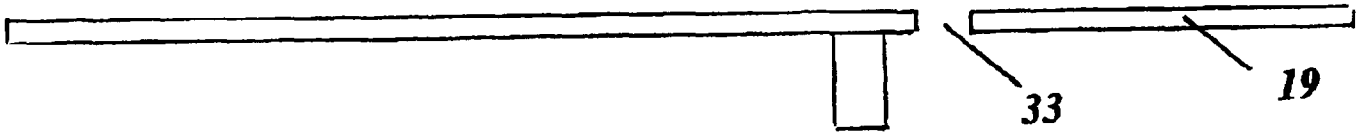
Fig. 12
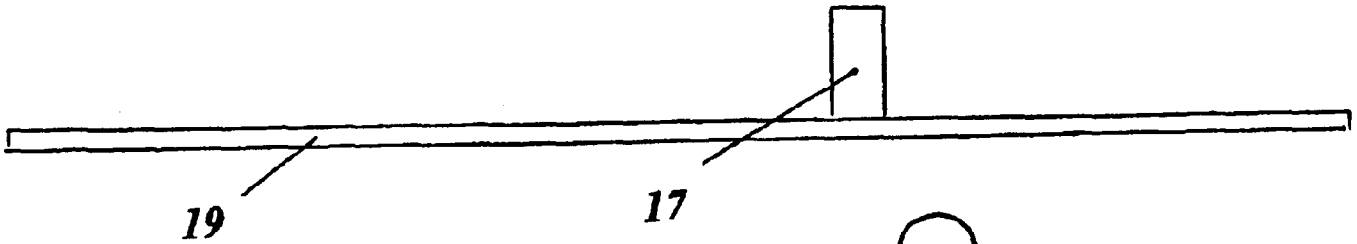
Fig. 13
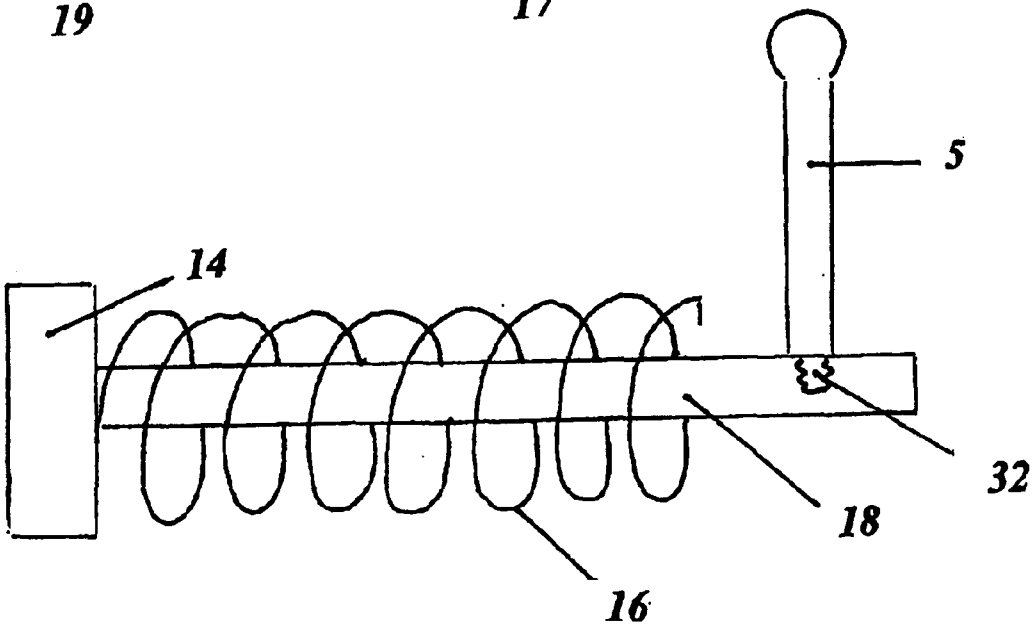

1
2
15
12
35
44
45
36
37
20
19
39

GOLF GREENS SPEED AND CONTOUR TEACHING DEVICE

BACKGROUND

In the game of golf, it has long been known and acknowledged that putting the ball on the green is a very integral part of the game. The putting makes up about half of the scoring in the game. Errors, or poor putting, is very damaging to the golfer's score. Many efforts have been made to help learn the skill of putting and most of these efforts have been directed to the golfer's swing, follow through, and gentle touch put on the putter when putting the ball across the green. There have been numerous aids or devices developed for the golfer to learn how to putt successfully. Putting pads (simulating greens), mirrors, laser beams, restricting boxes, arm straps, and numerous other innovations have been tried and have met with some success (action on the putter). The experienced golfer has difficulty at times reading these routes exactly. The experienced and professional golfers take years to learn the geographic and mathematical knowledge for this skill.

Teaching devices helped the golfer learn the putting stroke. However, if the golfer can stroke the ball perfectly he must also be able to determine the speed the ball needs to move and the route it takes to reach the hole. This must be read as a straight line and the contour of the land it must travel taken into account and evaluated. This takes skill and knowledge combined. This means he must read the undulations, slopes, downhill and uphill contours the ball will travel to reach the hole. If this is not determined correctly or "read" properly there is a good probability that the shot will be missed even though the golfer had the perfect swing pattern. As mentioned above the speed of the ball is also very important. The ball must have the momentum to get to the hole and yet if it has too much momentum or speed it may pass far beyond the hole even if the path is correct. It may pass over the hole and beyond the hole a long distance requiring another contour evaluation and another shot.

The speed of the green is determined by a variety and a surprisingly number of factors. The heighth of the grass, dampness, grass type, cutting of the grass, amount of wear, wind, etc all affect the speed of the green. The official speed of the green has been determined and given a number grade by using a Stimpmeter. This instrument was developed by Mr. Stimp in 1937 in England. It is still used today and considered the "standard" method.

These Stimpmeters are used by the large golf courses and their greens graded. They are expensive and smaller golf courses do not have these determinations. They are large and cumbersome and the general public does not have access to these unless they purchase the stimpmeter personally. It is for these reasons I have developed the following device for the average golfer. I feel it would be beneficial to help the golfer learn to read the greens. It is to be used only as a learning device and not used in a game.

SUMMARY

The putting portion of the game of golf accounts for half or more of the score. The winner of the golf game is the golfer with the lowest score. Since putting is so important and makes up such a large portion of the final score, the golfer must be a good at putting the ball in order to compete. No efforts have been made to give the putter methods to improve his ability to read the greens.

This new invention is presented and will be a good teaching way to speed up his learning process for reading the greens speed and contour. A tubular device that has a spring loaded plunger or piston to propell the ball out of the opposite end of the tube in a straight line. The plunger or piston has different stops where the tension of the spring is changed to allow different speeds and distances the ball will travel. Between 5 and 10 stops have been suggested for different distances and the first 2–3 stops can be used as a stimpmeter which will help determine the speed of each green.

The distance the ball travels is in a straight line and is always the same distance which is usually more accurate than the golfer's putt.

Since it will always travel in the same direction, and the same speed, it can be used to check where the ball should move to gauge the contour and the speed to the hole. This will help the golfer to decide where to shoot the ball. If wrong in his evaluation then he can rethink the shot and then try again. If this is not correct, again his knowledge will improve, and he can study the shot and learn by his mistakes. The device will help him learn both the speed the ball should travel and the route it should take with the contours of the green noted.

The device has a laser beam mounted on the front and top to help with the determination of the area to shoot the ball for the contour and speed. The device can store or carry one or more golf balls which will drop into place for shooting to the designated spot. The device is small enough to fit into the golf bag for carrying it easily to other courses and greens. The propelling plunger or pusher could also be motorized and a small motor used to actuate the plunger. The motor could be battery operated or electrically operated if desired. The trigger for the plunger could also be electrical (AC or DC) and the different positions for the plunger movement and placing the ball into the chamber for discharge can all be electrically connected. The simple method of using springs is felt to be a much easier and less complicated. The main action of a plunger propelling the ball out the end of the chamber like a bullet from the end of the gun is the basic idea for the invention.

In preparation, evaluation and studying the exact putting shot that is to be made, the golfer is only human and may make a mistake in putting the ball and it may travel in the wrong direction or be the wrong speed. He then does not know if his read of the green was correct and he struck the ball improperly or he did not read the green correctly. With this device it takes out the possibility of hitting the ball wrongly and just tells him if his read was accurate and correct. He can then determine where he made the mistake and correct it, learning from the mistake. This will help him in the game when faced with the same or similar shot. Using the device on several greens and at different positions will give the golfer a very good knowledge of where and how hard to strike the ball. This should greatly improve his game score.

DESCRIPTION OF THE DRAWINGS

FIG. 12 a cross-section of the housing for the plunger power drive arrangement.

FIG. 13 shows the power plunger and control lever along with the spring in place.

DETAILED DESCRIPTION OF THE INVENTION

Figure 1:
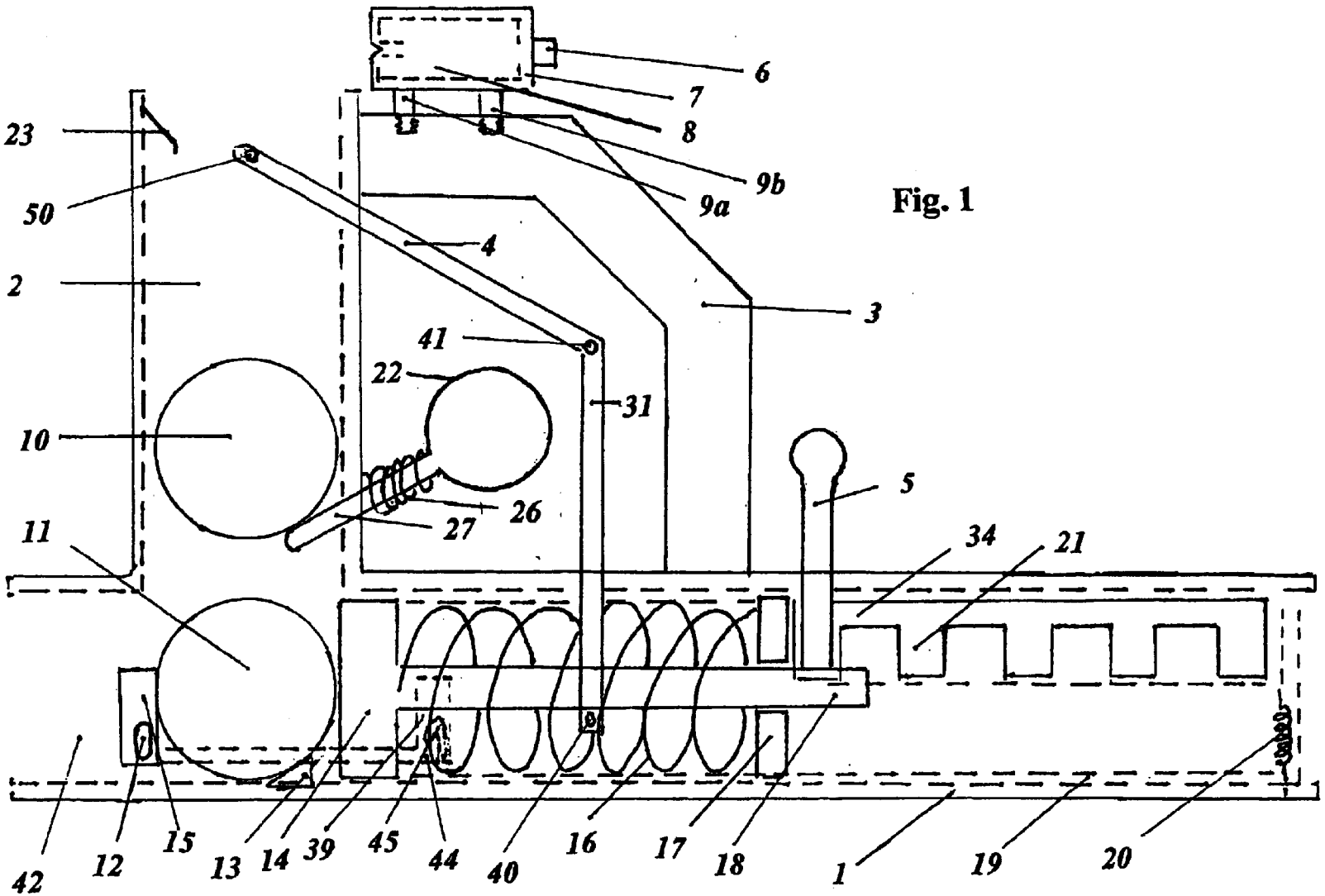
FIG. 1 is a cross-section of the device showing it's inside working actions plus the addition of the outside trigger and ball restrictive parts.

The device presented here is simply a cylinder holding a golf ball in position for a spring-activated plunger to strike the ball. This action propels the ball out the end of the cylinder, or chamber, and toward a designated position, much as a bullet passes through the cylinder, or barrel, of a gun. FIG. 1 demonstrates a cross-section of a prototype of the device, with element 11 demonstrating the ball in the expulsion chamber and element 14 showing the plunger, or driver, in the striking position. Presented also is a laser light, 8, attached to the device by a housing, 7, on the top of the handle represented by 3.

The distance the ball will travel is determined by the power control lever 5, which is attached to the shaft 18, of the plunger 14. Different speeds and distances the ball will travel is determined by the spring 16, and the increment compression slots represented by 21. The stronger the compression, the farther the ball will travel. If a short distance is desired a mild compression of the spring 16 is done using the power control 5 to place the plunger in the first or second setting slots 21, and longer distances would require the plunger 14 to be placed into the last two or three settings 21.

The golf ball falls into the empty discharge cylinder 42 by gravity from the reserve cylinder 2, after the restrictive rod 27 is pulled back using the attached ring 22. A holding spring 26 pulls the rod back into it's restrictive position when the rod is released preventing any other balls in the chamber 2 from also falling into the discharge cylinder 42.

When the ball 10, falls into the discharge chamber 42 it falls into a designated position. This exact position is necessary to allow the ball to be struck with the plunger 14, and give an accurate distance the ball will travel each time it is discharged. This is done by a triangular stop 13, posterior, and a mobile restrictive rod 12, interiorly. The mobile rod moves out of position when the trigger 4, to release the plunger 14, is activated. This then allows the golf ball 11, to move freely through the chamber and out the end, unimpeded.

The trigger 4 is attached to a cylinder 19 which is located inside the outside cylinder 1. This inside cylinder allows for activation of all of the actions to occur and occur simultaneously. The cylinder 19 has attached to it the arm 31, a part of the trigger mechanism, by the bolt 40 for it's movement. When the trigger 4 is pulled up, it causes the cylinder to rotate clockwise and its cutout edge, FIG. 17 element 38, causes the control lever 5 to move out of its designated position 21 into the free area 43 and thereby allowing the plunger 14 to move forward to strike the ball 11.
When the internal cylinder rotates to move the power lever 5 out of it's slot, it also turns the rod 44 and arm that controls the restrictive rod 12 moving this restriction from the ball's path and allows the ball to pass freely out of the chamber.

The reserve chamber 2 holds extra balls 10 until ready for usage. All of the balls are loaded in the top of the cylinder and pass over a safety pin type flexible wire 23 that has the form of a spring with one arm of the spring permanently open to restrict any ball exit attempts and yet is collapsible when allowing ball entrance into the chamber.

The lower portion of the reserve cylinder 4 has a restricting rod 27 that prevents the extra balls from entering the discharge chamber 42 until the chamber is empty and ready for the next ball. This rod 27 has a spring 26 that constantly holds the rod position protruding into the cylinder 2 except when the spring is stretched by pulling back on the ring 22, and when released readily returns the restricting rod to the locked or blocking position.

Figures 20, 21:
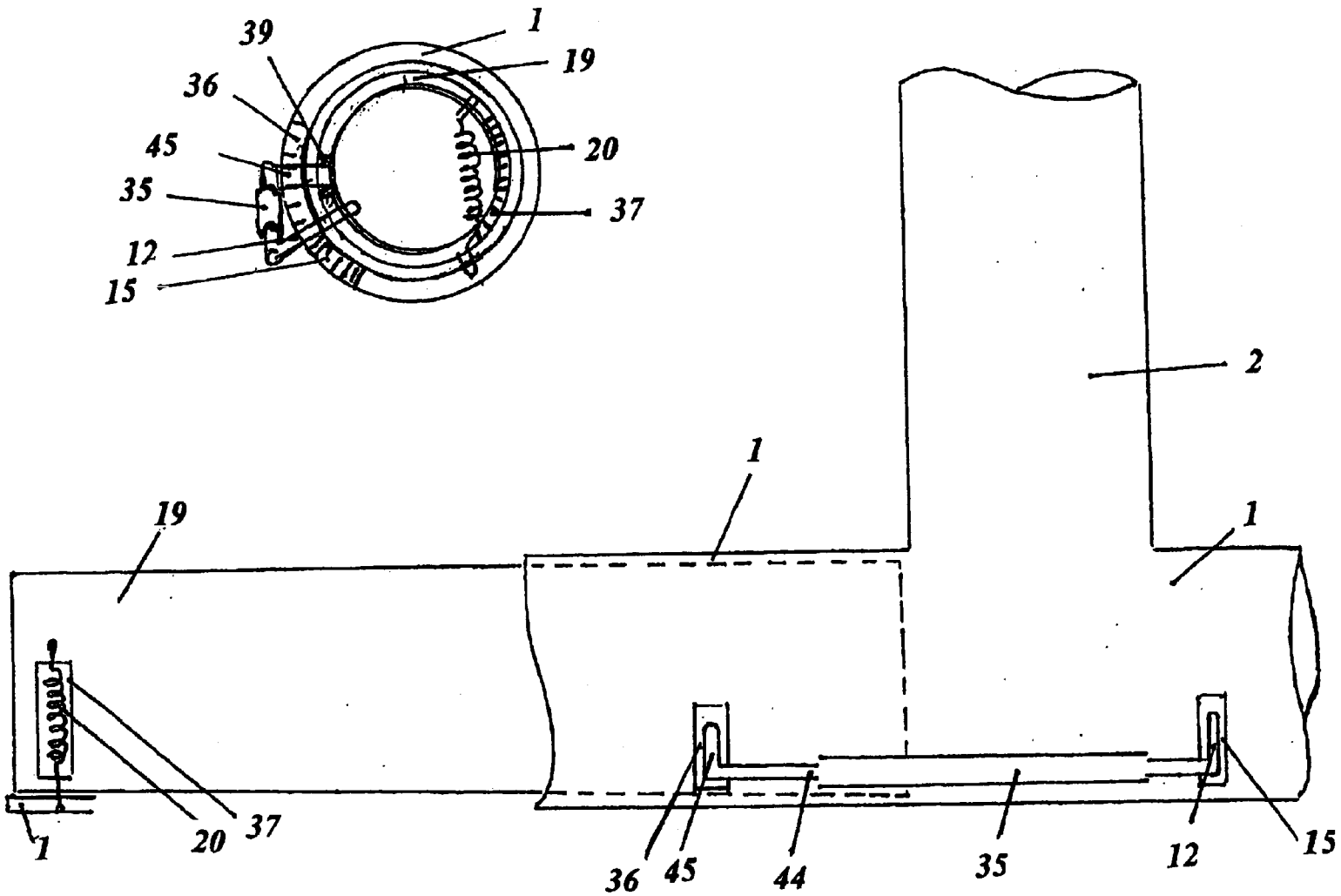
FIG. 20 shows a cross-section of the action mechanism of the inner cylinder working on the outer cylinder to acdtuate the ball retension release and return with the spring causing the return.
FIG. 21 indicates the action of the ball retension mechanism and the spring returning the cylinder to it's original position.

For clear understanding of the triggering mechanism, it is necessary to know there is a cylinder 19 inside the outside cylinder 1 to allow the trigger actions to occur as seen in FIG.21. The inner cylinder 19 extends only about two thirds of the distance to the end of the device.

In the rear, or back, of the inner cylinder 19 element, is another spring designated 20 which has the sole purpose of returning the triggered cylinder back to its original or resting position. One end of the spring 20 is bolted to the inner cylinder 19 and, through a slot 37 in this portion of this cylinder 19, the other end of the spring is attached to the outside, stationary, cylinder 1. This allows the inner cylinder 19 to move and trigger the actions that occur when this cylinder 19 is rotated; causing the spring to be stretched and thereby create tension in the spring and when the trigger of the cylinder is released the spring rotates the cylinder 19 back to its resting position. The cylinder's return location is limited by the bolt attaching the spring to the outside cylinder 1 and by the provided slot 37. The actions would occur again when the driver, or plunger, 14, is reloaded, or empowered, by manually placing the power lever 5 in the desired position in the slot 21, thus causing spring tension from the plunger spring 16, released when the inner cylinder 19 is slowly rotated clockwise by using trigger 4. Cylinder 19 contacts the plunger lever 5, located in slot 21, with further rotation pushes the lever 5 out of the slot 21 into the free zone 43 thereby allowing the plunger to thrust forward by the action of spring 16 recoil.

Further actions caused by the inner cylinder 19 are in the front, or anterior, portion of the device. The cylinder has an action on the rod 44 by moving the projected portion of that rod labeled 45 counter-clockwise. It does this action by moving the portion of that rod 44 which is projected, and labeled 45, located in a hole in the inner cylinder 19 after passing through a slot 39 in the outer cylinder 1. With the end of this rod portion 45 projecting into the hole in the cylinder 19, the rod 44 rotates when the end 45 is moved counter-clockwise rotating the opposite end 12, also projected inwards and into the discharge chamber through slot 15. The purpose of this projection is to hold the chamber ball in position and prevent forward movement until time for discharge. The rod is rotated by the cylinder 19 so as to rotate the rod 44 which are enclosed in a cylinder 35 attached to the body 1 firmly. When the rotation occurs the projected portion 12 moves out of the discharge canal 42 and allows the ball to move out of the chamber freely.

Figure 4:
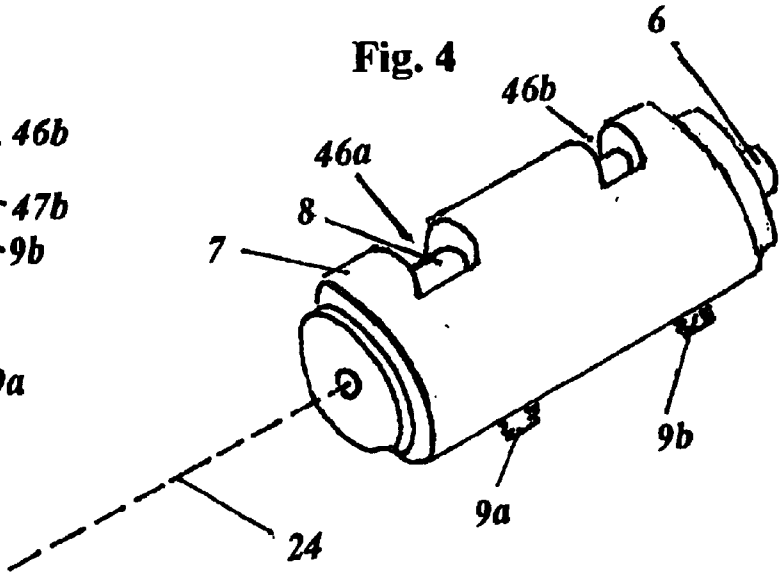
FIG. 2 thru FIG. 7 shows the laser beam conponent with it's housing in several views.
Figure 3:
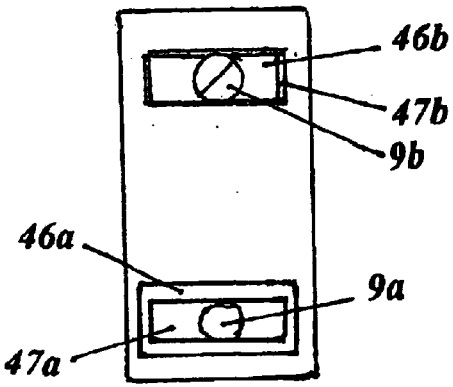
Figure 2:
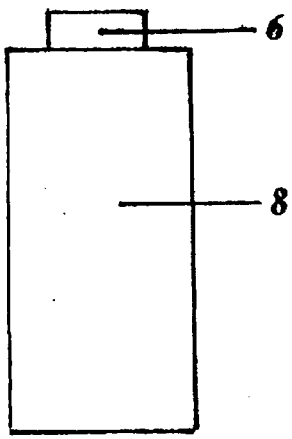
Figure 7:
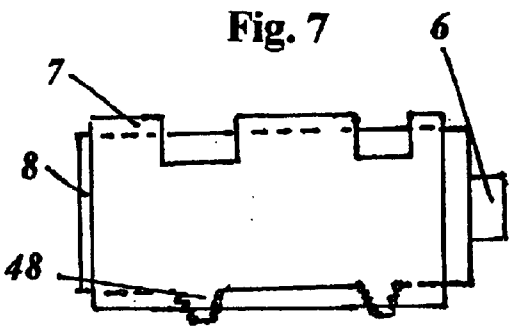
Figure 6:
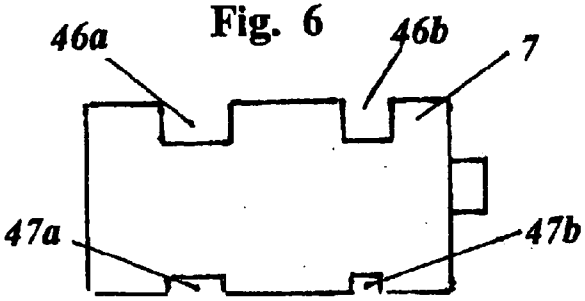
Figure 5:
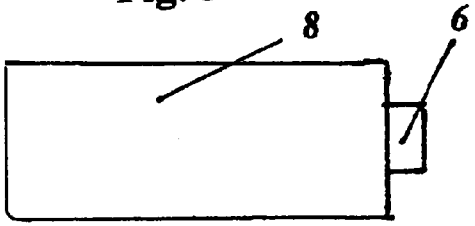

FIG. 2 shows the laser light with 6 demonstrating the trigger for the light and 7 the body of the laser light. The body of the laser light is housed in a casing 7 as seen in FIG. 4. The casing 7 has attachments of screws 9*a* in front and 9*b* in the back of the casing as seen in FIG.4 and the beam 24 of the laser directed out the front of the light. There are two dorsal slots, one interiorly 46*a* and one posterior 46*b*. These slots are used to gain access to the bolts 9*a* and 9*b* on the bottom of the casing. The slotted connections on the bottom of the casing are wider than the screw holding the casing 7 onto the handle 3. This allows for adjustments for the direction of the light beam 24 and to make certain the light is true and straight with the shooting device. The laser light 8 is inserted into the casing 7 and the light is trued or adjusted, then removed gently from the casing 7. The screw 9*a* is press-fitted into the body of the slot 46*b*. This allows the screw to turn in the content of the body of the housing 7 and in slot 46*b* and either raise the end of the light casing 7 by loosening the screw or lower the end by tightening the screw 9*b*. This allows for the light beam 24 to be raised or lowered. The anterior slot 47*a* permits the adjustment of the beam to the right or the left. Noted in FIG. 3, from the 46*a* slot on the top of the laser casing 7*a* lower slot 47*a* is seen. There is no slot on the posterior or back screw attachment. There is here a hole only 47*b* for the head of the screw 9*b* to inserted. This screw 9*b* raises or lowers the beam 24 as needed as there is a small washer 48 under casing 7 screw 9*a*, FIG. 7, and also under 47*a* opening to allow for this up or down motion. The slot on the anterior end 47*a* is wide as noted in FIG.6 and allows the casing to be turned to the right or left with the screw 9*a* loosened. This screw is then tightened to secure this position if correctly located.

Figures 8, 9:
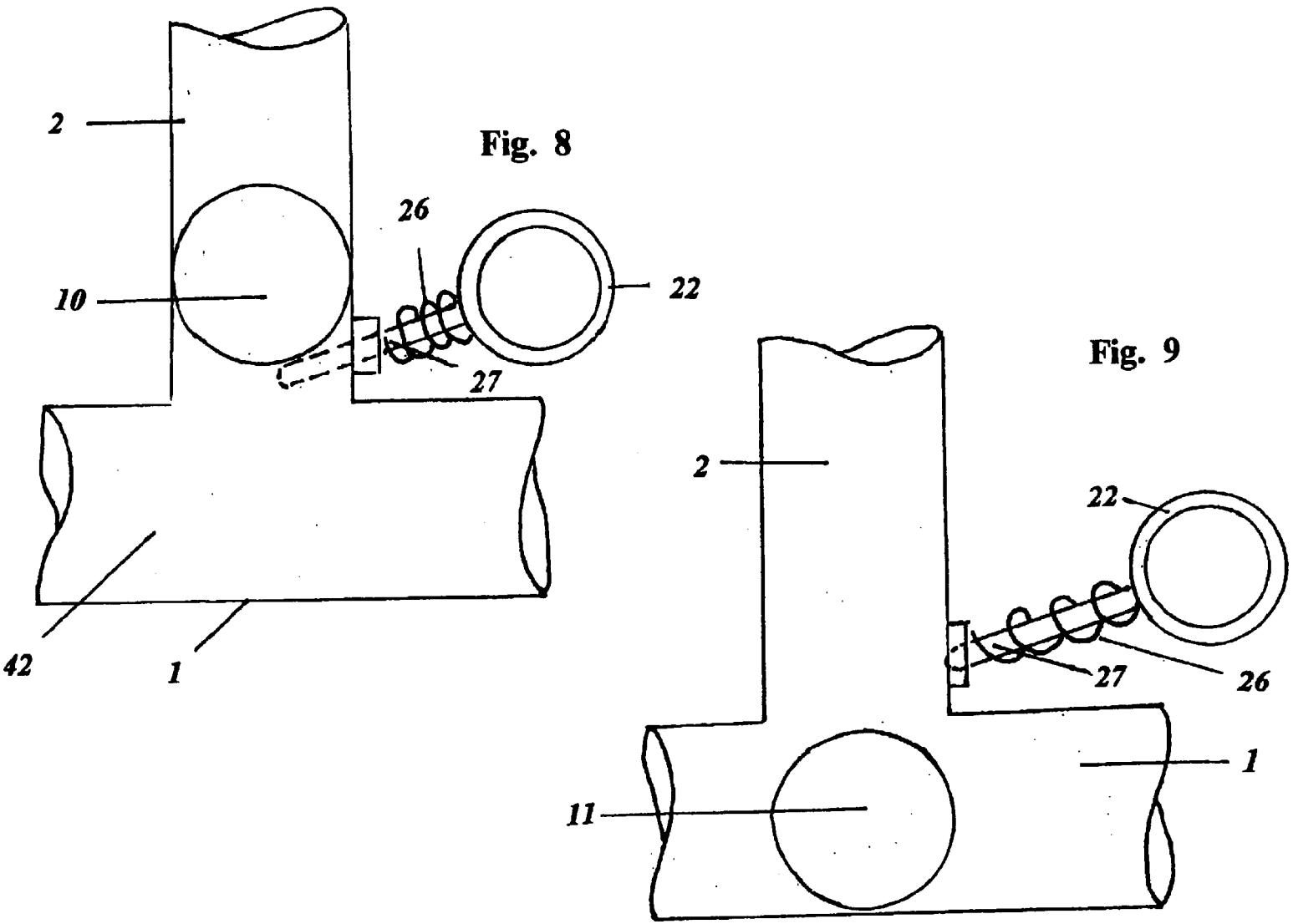
FIG. 8 shows the ball retension mechanism limiting the ball in the reserve area.
FIG. 9 shows the ball retension mechanism released to allow the ball to move into the expulsion position in the discharge chamber.

FIG. 8 demonstrates again the action of the reserve chamber 2 for balls 10 waiting to be dropped into the discharge chamber 42, which is the front portion of cylinder 1. The restrictive rod 27 prevents the ball 10 movement until it is retracted out of the reserve chamber by manually retracting the rod using the pull ring 22 FIG. 9. The spring 26 is stretched when the rod 27 is retracted out of cylinder 2 as shown in FIG. 9 allowing for the reserve ball 10 to drop into chamber 42 and become the discharge ball 11. The expanded spring 26 when released recoils to bring the rod 27 back into its restrictive position. This action then prevents the next ball from attempting to enter cylinder 42. The reserve ball 10 10 falls into the chamber 42, then becoming the discharge ball 11, as again seen in FIG. 9.

Figure 10:
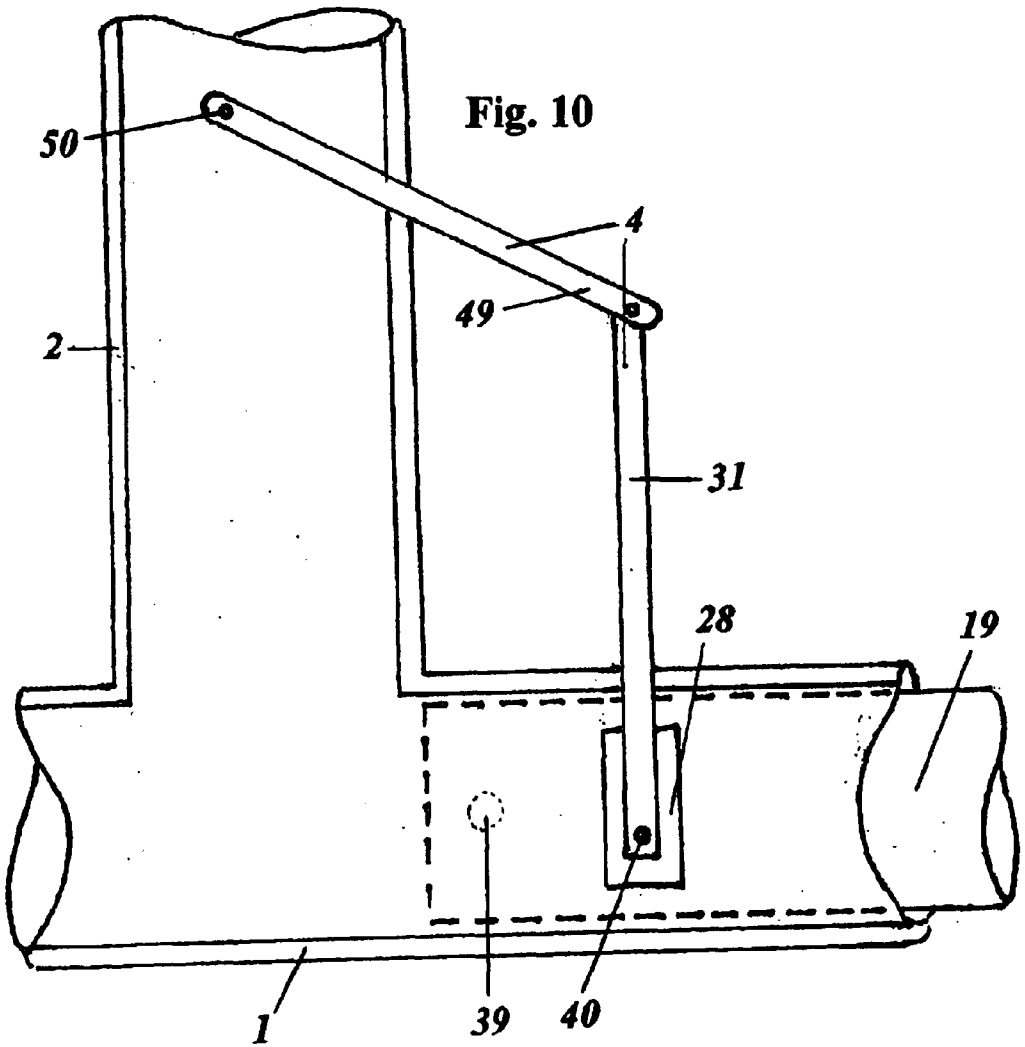
FIG. 10 depicts a side view of the trigger method used.

FIG. 10 depicts the trigger action for the device. The trigger 4 is made up of two arms 49 and 31, and three bolts 50, 41, and 40. The only action the trigger does is to rotate the internal cylinder 19 clockwise for a short distance. This is accomplished by pulling up on lever arm 49, which then pulls arm 31 upward and being attached with bolt 40 to the cylinder 19 causes the clockwise rotation of the cylinder 19 inside of cylinder 1. The attachment of the lever arm 31 is by a lag bolt loosely attached to allow the cylinder to make a small arc due to its contour. This action is made possible by a slot 28 that allows the arm 31 to be located outside the cylinder 1 and make the movement through the slot onto cylinder 19.

Figure 11:
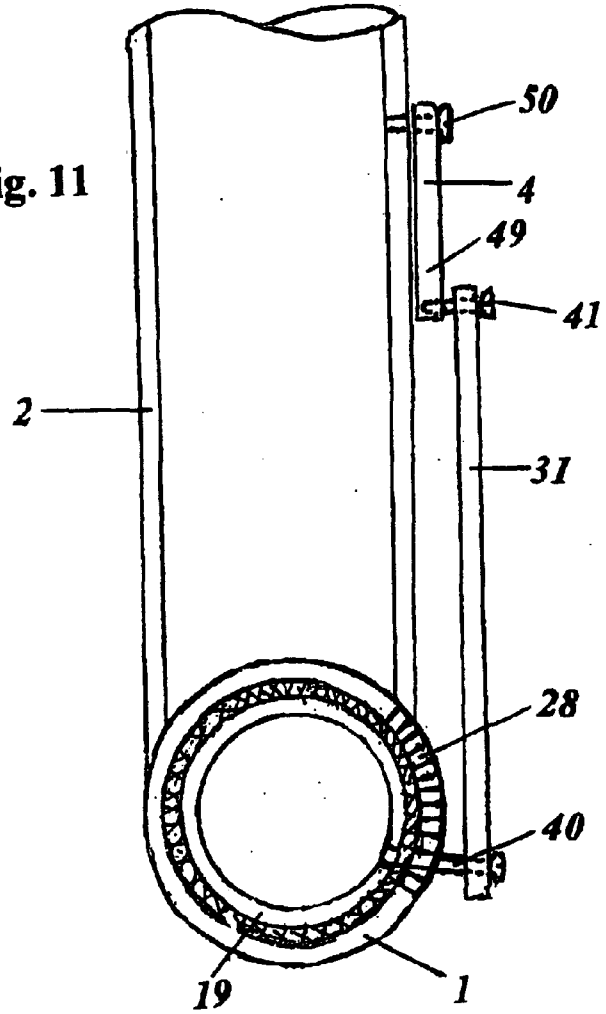
FIG. 11 shows the chamber frontal view with the trigger mechanism working on the inside cylinder to indicate it's action there.

FIG. 11 shows a frontal cross-sectional view of the actions of the trigger 4,again with its upper arm 49 and lower arm 31 attached to the reserve cylinder 2,and the stationary cylinder 1. This figure shows the lag screw 40 and its loose attachment to the inner cylinder 19. The cross-hatched area 28 indicates the opening in cylinder 1 to permit the lag screw 40 to attach to cylinder 19.

Figure 14:
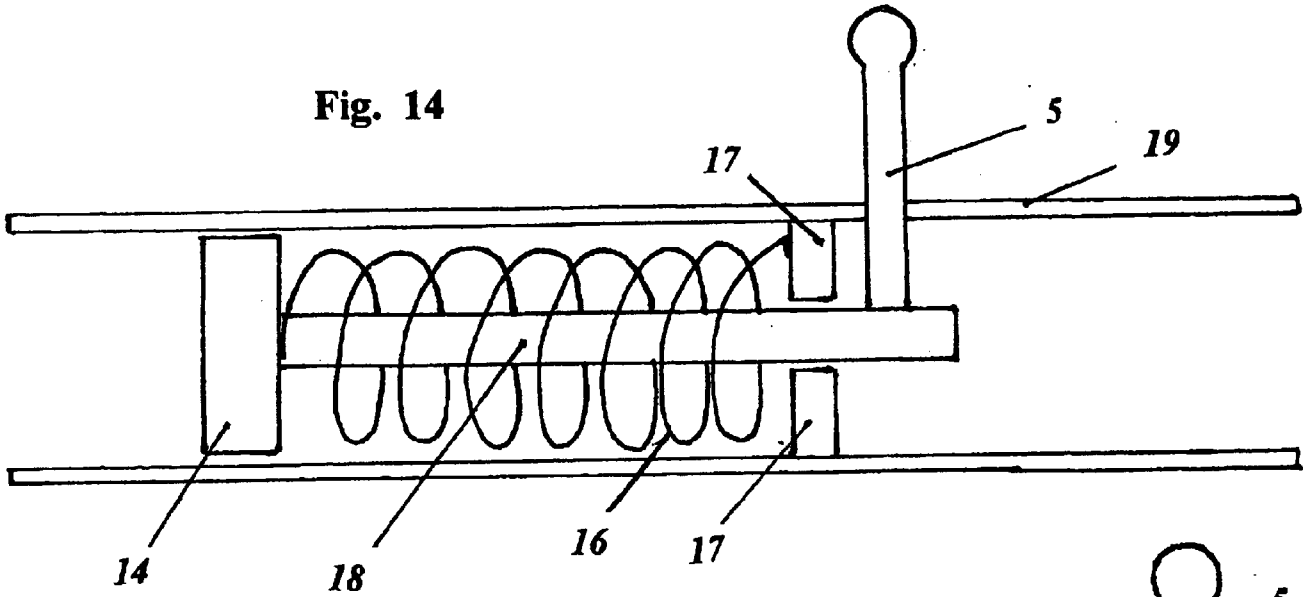
FIG. 14 this indicates the power driving plunger in the housing.
Figure 15:
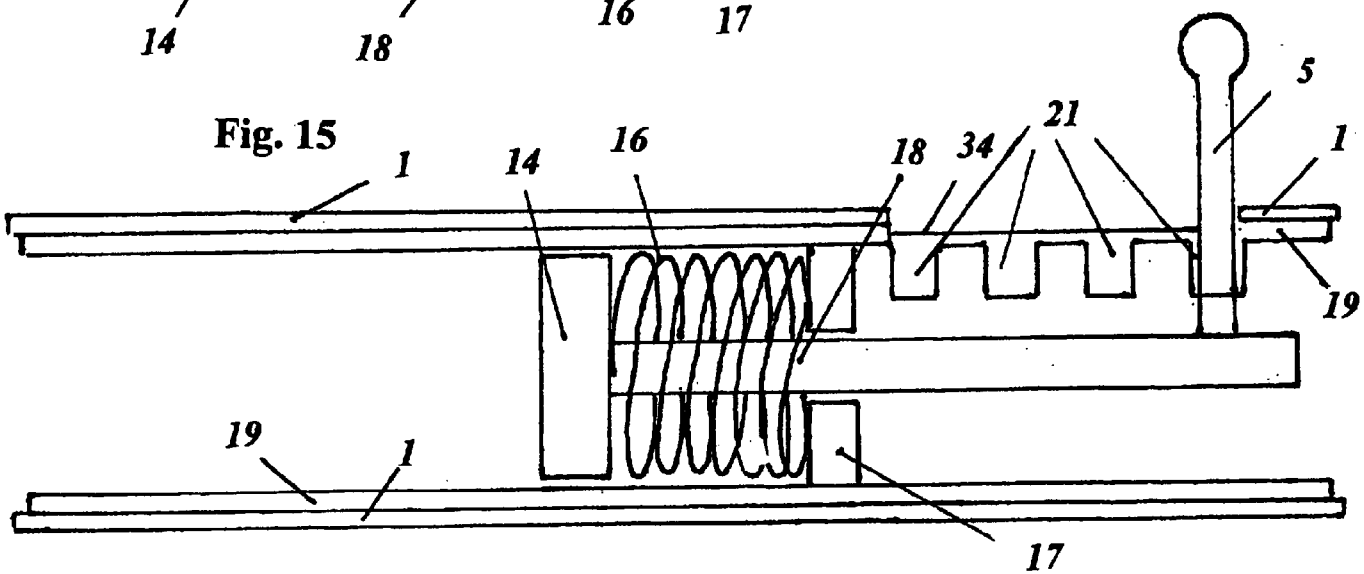
FIG. 15 this demonstrates the power plunger in a coiled and driving position.

The driver, and mechanism of action, is seen in FIG. 12, FIG. 13, FIG. 14, and FIG. 15. FIG. 12 demonstrates the stop 17 which acts as a buttress for the plunger spring 16 action. When the spring is compressed as in FIG. 15, the shaft 18 of the plunger passes through a center opening in the stop 17, which have a disc like design. It is circular and appears as a thick washer firmly affixed to the inside wall of cylinder 19. This allows the pressure of the spring 16 to be as strong as needed pressing against it's surface. When the inside cylinder is rotated for the trigger mechanism to function, this stop 17 also rotates since it is firmly attached to the wall of the cylinder 19. This motion does not change the spring tension or influence the plunger 14 movement since the spring 16 and the whole mechanism of the plunger head 14, the shaft 18 and the lever arm 5 also move when the inner cylinder moves the lever 5 out of its position 21 into the free area 34 for action of the mechanism. The resting position. of the spring is seen in FIG.14 with the relaxed spring 16 and the extended position of the plunger 14. FIG. 15 shows the position of the driving mechanism when placed in position for action to occur. The power lever arm 5 is located in a setting 21 holding the spring 16 compressed against the stop 17. FIG. 13 reveals the power lever 5 affixed to the shaft 18 by the threads 32 on the end of the lever allowing for a strong tight fixation. This allows the power lever 5 to be removed when needed, especially with assembly of the device.

Figure 16:
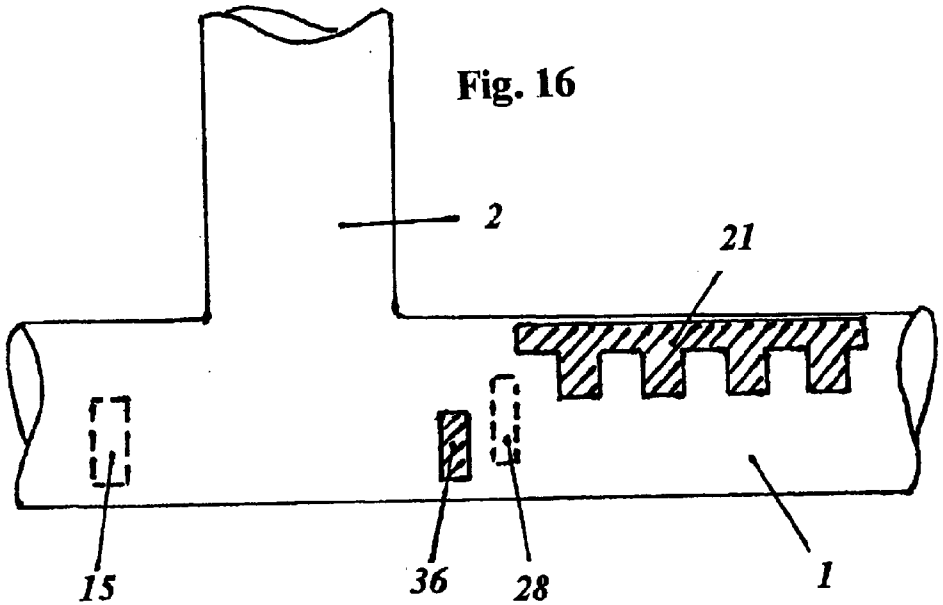
FIG. 16 this shows the housing for the trigger mechanism and slot positions for the ball retaining rod.

Seen in FIG. 16 is the outside cylinder 1, with its cutout power lever locations 21 and other slot openings, 15 and 28, for the action of the ball restrictor rod and slot 36 for the trigger connection. The slots for the ball restrictor 15 and 28 are located on the right side of the device as shown by broken lines. Seen here is also the reserve chamber 2.

Figure 17:
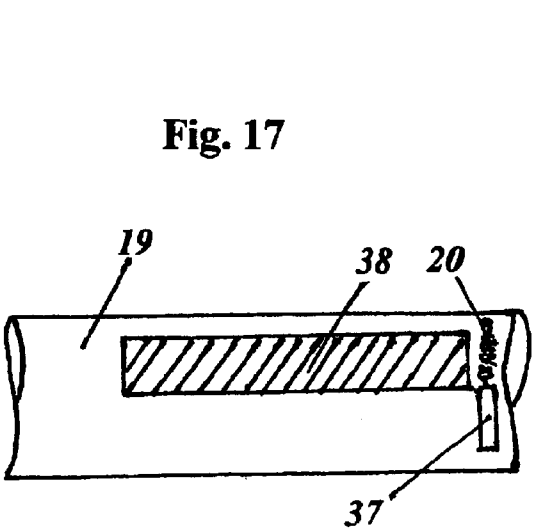
FIG. 17 this shows the inside cylinder which moves and causes the release of the driver and the ball release mechanisms.

FIG. 17 exhibits the inner cylinder 19 which has a large opening 38 and a slot 37. The spring 20 is also represented here. The cylinder 19 fits inside cylinder 1 and lines up so the slot 38 is beneath slot 21 in cylinder 1. This will allow for the cylinder 19 to use the bottom edge of the slot 38 to push the power lever out of its position in one of the slots 21. As it rotates clockwise by the trigger movement made possible through slot 36 and connected by bolt 40.

Figure 19:
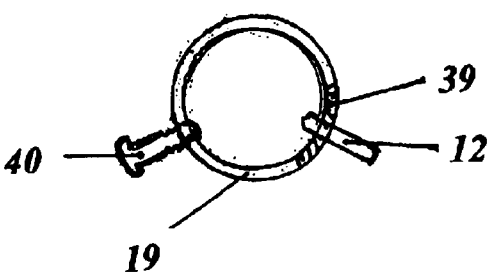
FIG. 19 shows a cross-section of the inner cylinder with a screw and rod in place.
Figure 18:
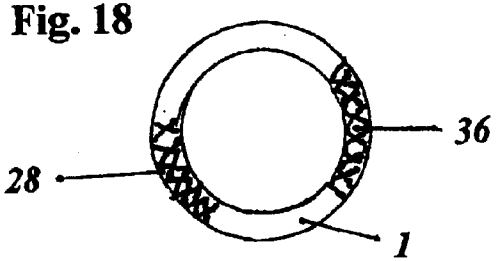
FIG. 18 depicts a cross-section of the outer cylinder with some slot locations for actions to occur.

FIG. 18 shows the location of the slots of the outer cylinder 1 and FIG. 19 indicates the location of the trigger bolt 40 and the restrictor rod arm 12 in opening 39 on the inner cylinder 19.

FIG. 21 shows the right side of the device and is particularly presented to demonstrate the location of the restrictor rod 44, its cylindrical attachment 35, and the extended arms 45 and 12. A cutaway section shows the spring 20 attached to the cylinder 19 and also attached to cylinder 1. This allows the return of the cylinder to its original position when the trigger is released. The inner cylinder 19 is seen in the cylinder 1 extending to the edge of the posterior attachment of chamber 2, by using broken lines. This FIG. 21 further represents the action of the restrictor bar arm 12 which moves down to the bottom of the discharge chamber 42 when the opposite end 45 is rotated counterclockwise causing this action. This is demonstrated in FIG. 20 illustrating a view from the front of the device and showing the protrusion of the arm 12 and 45 and the open slots 15 and 36 superimposed on each other for demonstration only. FIG. 20 also shows the opening location 37 for the spring 20 to keep the cylinder 19 pulled into its resting position.

The components of the device can be made of plastic or metal. Other materials such as wood, ceramic, or paper are possible also. The prototype was made of plastic, with a metal lever arm, bolts, springs and plunger shaft.

Changes that could be done is the reserve chamber could be omitted and one ball could by loaded into the discharge chamber each time. The mechanisms could also be motorized.

I claim:

1. A spring loaded, hand held, device for the projection of a golf ball across a surface at a certain speed; made of light-weight metal or plastic, whereas a spring located in the device activates a plunger that strikes a golf ball located in a cylindrical chamber, thereby causing the ball to discharge through the chamber and onto the surface; the speed of which the ball travels is governed by the tension made on the spring in the device; that said device has spring tension increment positions located on the device to allow variable spring strength releases onto the aforementioned plunger striking the said chamber loaded ball; and located on the device a laser which directs a beam whose end spot acts as a target for the direction of the ball to travel thereby allowing the operator to study the route the ball follows when directed to that point with the influences it receives from the contours and obstructions of the surface it travels upon.

2. The spring loaded, hand held, device of claim 1 further comprising a laser light attached to the device.

* * * * *